United States Patent [19]

Bonini

[11] 4,238,053

[45] Dec. 9, 1980

[54] DEVICE FOR DISPENSING CHILLED LIQUID

[76] Inventor: Nelson Bonini, Aprigio de Araujo St. No. 973, Sertaozinho, Sao Paulo, Brazil

[21] Appl. No.: 909,293

[22] Filed: May 24, 1978

[51] Int. Cl.[3] ..... B67D 5/56

[52] U.S. Cl. ..... 222/129.1; 62/399; 222/146 C; 222/185; 222/401

[58] Field of Search ..... 222/146 C, 129.1–129.4, 222/181, 185, 325, 167, 401, 402; 62/396, 399; 248/130

[56] References Cited

U.S. PATENT DOCUMENTS

| | | | |
|---|---|---|---|
| 662,168 | 11/1900 | Emerick | 62/399 X |
| 719,212 | 1/1903 | Guttenberg | 62/399 X |
| 735,295 | 8/1903 | Price | 222/146 C X |
| 1,004,019 | 9/1911 | Griffiths | 222/442 |
| 1,088,261 | 2/1914 | Dade | 222/401 X |
| 2,313,954 | 3/1943 | Mariani | 222/146 C X |
| 3,147,890 | 9/1964 | Mittelsteadt | 222/325 X |
| 4,033,483 | 7/1977 | Neidorf | 222/185 X |

FOREIGN PATENT DOCUMENTS

| | | | |
|---|---|---|---|
| 32224 | 9/1927 | France | 222/401 |

*Primary Examiner*—F. J. Bartuska

*Attorney, Agent, or Firm*—Steinberg & Raskin;

[57] ABSTRACT

A device for dispensing chilled liquid includes a container adapted to contain a refrigerating medium such as ice. The container carries a manually operable discharge valve through which the chilled liquid may be discharged. Also the container has in its interior a tubular coil one end of which is connected to the discharge valve for supplying liquid thereto. The container has a wall portion formed with an opening passing therethrough, and the other end of the coil communicates with this opening. A tubular carrier is connected to the container at the opening of the wall portion thereof and has a hollow interior communicating through this opening with the coil. The tubular carrier has a fitting capable of removably receiving a liquid-containing receptacle. The liquid in the receptacle can flow through the fitting and along the interior of the tubular carrier into the coil to be chilled by the refrigerating medium, so that in this way the valve can be manipulated to discharge liquid in a chilled condition from the container.

3 Claims, 4 Drawing Figures

DEVICE FOR DISPENSING CHILLED LIQUID

BACKGROUND OF THE INVENTION

The present invention relates to liquid-dispensing devices.

In particular, the present invention relates to devices for dispensing liquid in a chilled condition.

Thus, the device of the invention may be utilized in connection with dispensing beverages, such as beer, soft drinks, or the like, in a chilled condition.

As is well known, it is highly desirable to serve a beverage such as beer in a chilled, well-iced condition. Even when the beer is removed from a refrigerator, the first glass is always the best, while subsequent glasses are less desirable inasmuch as the beer warms during the drinking of the first glass, and thus is not in a well-chilled condition when poured into a second and subsequent glasses.

Thus, when a beverage such as beer is served at bars, hotels, restaurants, or even in the home, it is customary to remove a bottle of beer from a refrigerator and to pour part of the contents of the bottle into a glass while the bottle remains standing so that the contents thereof warm up toward the room temperature while the first glass is consumed. Any beverage which remains outside of a refrigerator or the like for any appreciable interval of time will undesirably warm up toward the room temperature so as to place the beverage in less than the optimum condition for consumption.

SUMMARY OF THE INVENTION

It is accordingly a primary object of the present invention to provide a device which will avoid the above drawbacks.

In particular, it is an object of the present invention to provide a device which will assure that a beverage is always served in a well chilled condition even though the beverage is taken from a partly empty receptacle.

Thus, it is an object of the present invention to provide the possibility of serving a beverage in a well chilled condition even if a certain time has elapsed subsequent to the opening of the receptacle in which the beverage is contained.

Thus, it is an object of the present invention to make it possible for the host at a party, for example, to be unconcerned with respect to the necessity of serving beverages in a chilled condition.

It is also an object of the present invention to provide a device of the above type which is relatively simple and inexpensive while operating in a highly reliable manner.

Furthermore, it is an object of the present invention to provide a device of the above type which is simple to operate and which will reliably dispense all of the beverage from a given receptacle.

Furthermore it is an object of the present invention to provide a device of the above type which can easily be maintained in a clean, sanitary condition.

Also, it is an object of the present invention to provide a device which will not require unopened bottles to be chilled, so that unnecessary cooling of unused bottles of beer or the like will not be required.

According to the invention a container means is provided for containing a refrigerating medium such as ice. This container means carries a manually operable discharge valve means accessible at the exterior of the container means for discharging a chilled liquid therefrom. Distant from the discharge valve means the container means has a wall portion formed with an opening passing therethrough. In the container means there is a tubular coil means one end of which communicates with the discharge valve means and the other end of which communicates with the opening at the wall portion of the container means, so that when a liquid is supplied to the latter opening the liquid can flow through the coil means to the discharge valve means with the liquid being chilled as it travels through the coil due to the heat-exchange relationship between the refrigerating medium at the exterior of the coil and the liquid in the interior of the coil. The container means carries at the opening thereof a tubular carrier means which has an interior space communicating through the opening in the wall portion of the container means with the coil in the interior thereof. This tubular carrier means carries a fitting means for releasably connecting to the carrier means a receptacle which contains a liquid which is to be dispensed, this fitting means also communicating with the interior of the tubular carrier means so that liquid from a receptacle connected to the fitting means will flow through the latter and through the tubular carrier means into the coil means to be chilled before reaching the discharge valve means.

BRIEF DESCRIPTION OF DRAWINGS

The invention is illustrated by way of example in the accompanying drawings which form part of this application and in which.

DESCRIPTION OF PREFERRED EMBODIMENTS

Figure 3:
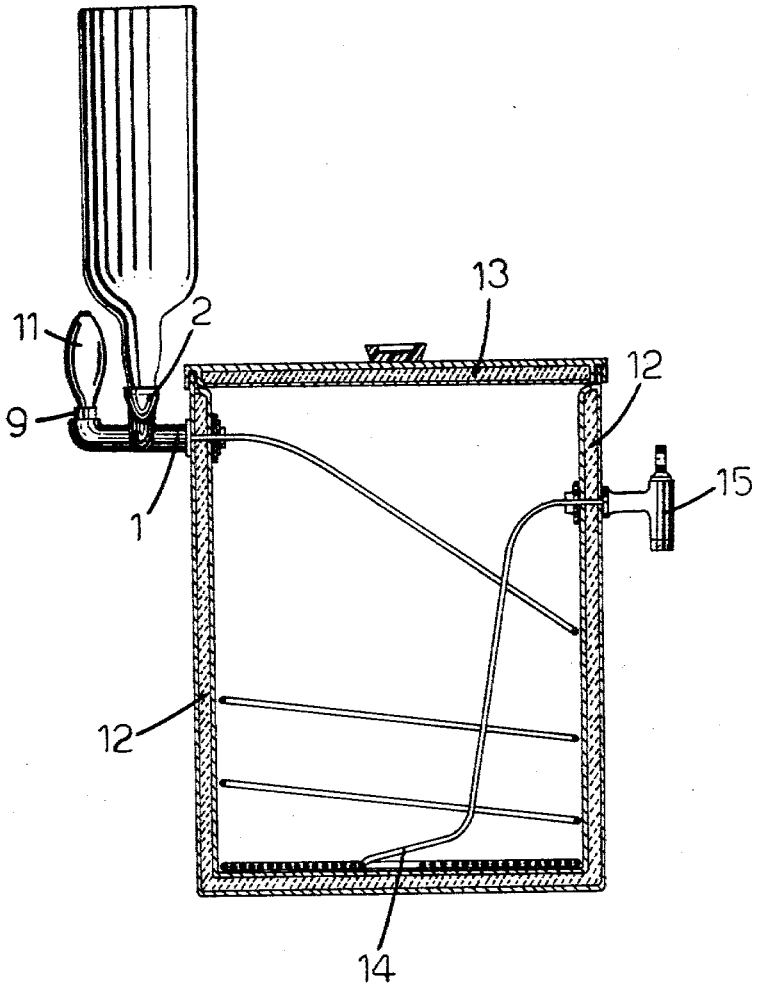
FIG. 3 is a sectional elevation of the structure of FIG. 2 with FIGS. 2 and 3 showing how the structure of FIG. 1 is connected with the remaining structure.

Referring first to FIG. 3, it will be seen that there is illustrated therein a container means 12 which is adapted to contain a refrigerating medium such as ice. Thus the container means 12 is in the form of a suitable bucket which has an open top capable of being removably closed by the lid 13. At its right portion, as viewed in FIG. 3, the wall of the container means 12 carries a discharge valve means 15 which is manually operable and in the form of a suitable tap or faucet. Distant from the discharge valve means 15, the container means 12 has a wall portion formed with an opening passing therethrough, and in FIG. 3 this wall portion is at the upper left region of the container means 12. The opening at the wall portion at the upper left part of the container means 12, as viewed in FIG. 3, communicates fluid-tightly with one end of a tubular coil 14, the opposite end of which is fluid-tightly connected with the discharge valve means 15. The coil means 14 may be in the form of a flexible tubular hose of rubber or other plastic or may be a metal coil. The end of the faucet 15 which is carried by the container 12 carries a suitable fitting such as an externally threaded tubular portion onto which an internally threaded tubular fitting connected to one end of the coil 14 is threaded so as to provide for communication between the coil 14 and the faucet 15 in this manner. In the same way, the opening in the wall portion of the container means 12 may be internally threaded to have threaded into the same the exterior threads of a tubular fitting connected to the opposite end of the coil 14.

At the opening in its wall portion, to which one end of the coil 14 is connected, the container means 12 carries a tubular carrier means 1 which in turn carries a plurality of fitting means 2 respectively provided for releasably connecting to the carrier means 1 receptacles such as beer bottles, for example, as indicated. The tubular carrier means 1 has a hollow tubular interior which extends horizontally, as viewed in FIG. 3, up to the opening of the wall portion of the container 12, this hollow tubular interior forming a main passage of the tubular carrier means 1. At its right end, as viewed in FIG. 3, the tubular carrier means 1 has a thread which by way of the nut illustrated in FIG. 3 enables the tubular carrier means 1 to be releasably fixed to the container means 12, this nut being turnable on a circular exteriorly threaded ring fixed to and extending from the container 12 while surrounding the opening thereof to which one end of the coil 14 is connected as described above. Thus through this structure it is possible to releasably fix the tubular carrier means 1 to the container means 12 in a position extending therefrom as illustrated in FIG. 3, with the tubular interior which forms the main passage of the tubular carrier means 1 communicating with the coil 14.

Figure 1:
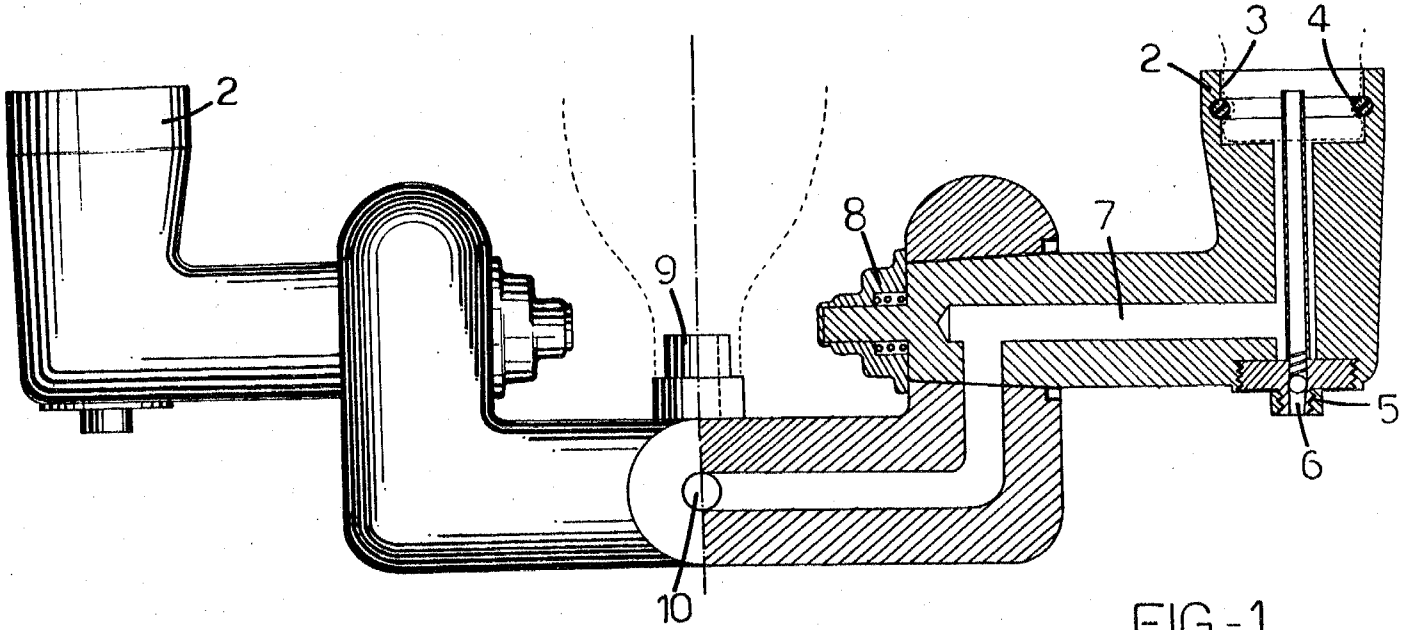
FIG. 1 is a partly sectional elevation of a tubular carrier means of the invention shown in FIG. 1 with a pair of fitting means which are carried thereby, with the right portion of FIG. 1 being exploded to show a means for introducing air into the fluid-flow passage of the structure of FIG. 1.

As may be seen from FIG. 1, the carrier means 1 is provided with the main passage 10, the illustration in FIG. 1 being in a plane transverse to FIG. 3, and extending through the fittings 2. Thus, as may be seen from FIG. 1, the elongated tubular portion of the carrier means 1 which is connected to the container 12 has a pair of tubular branches which form extensions of the main passage 10, and these branches each terminate in upwardly extending tubular portions to which the fittings 2 are respectively connected.

Thus, at each upwardly extending portion of each branch of the tubular carrier means 1, shown in FIG. 1, this branch is formed with a tapered aperture passing therethrough and receiving a tapered portion of a fitting means 2. This tapered fit is such that it is fluid-tight while at the same time permitting turning of each fitting means 2 about the horizontal axis of tapered opening. Each fitting 2 carries a pin which receives a cup 8 which is threaded onto this pin, and the cup 8 can be turned so as to tighten or loosen the connection of the fitting 2 to the carrier means 1. A spring is coiled around the threaded stud which projects from the fitting 2 and onto which the cup 8 is threaded so as to eliminate any play in the threaded connection.

As is apparent from FIG. 1, each fitting means 2 is of an elbow-shaped or substantially L-shaped configuration, having the L-shaped passage 7 which at the tapered end portion of the fitting 2 has a branch communicating with the main passage 10 of the carrier means 1 in the manner apparent from FIG. 1. It will be seen that the passage 7 in the elbow-type of fitting 2 terminates at its upper end, as viewed in FIG. 1, in an enlarged portion 3 capable of receiving the mouth of a beer bottle or the like from which the cap has been removed. In the recess portion 3 the fitting means 2 carries a sealing ring 4 past which the mouth of the bottle snaps when introduced into the recess 3.

When attaching a bottle to the fitting means 2, the latter is turned through 180° from the position shown in FIG. 1 so that the recess 3 is directed downwardly, and then the open top of the bottle is snapped into the recess 3, and with the bottle attached thereto the fitting 2 is turned back to the attitude shown in FIG. 1, so that the bottle is inverted and the contents thereof can flow through the passage 7 and then through the main passage 10 to the coil 14 to reach the discharge valve means 15.

In the example shown in FIG. 1, the carrier means 1 carries a pair of fittings 2, so that two bottles can be connected to the pair of fittings 2 shown in FIG. 1, for simultaneous delivery of liquid to the coil 14. If only one bottle is to be used, then the unused fitting means 2 is turned so that its recess 3 is directed downwardly, and thus the passage 7 of such a fitting 2 will not communicate with the tubular interior passage 10 of the carrier means 1. Moreover, as is apparent from FIG. 1, it is possible to turn the pair of fitting means 2 shown in FIG. 1 respectively into preselected angular positions which will provide for a predetermined mixing of the contents of a pair of liquid-retaining receptacles.

Each fitting 2 is also provided with an opening 5 forming a downwardly extending vertical extension of the vertical part of the opening which extends from the recess 3 to the horizontal portion of the passage 7 as viewed in FIG. 1. This opening 5 is internally threaded and is capable of receiving the breather tube 6 which is shown at the right of FIG. 1 below the sectionally illustrated fitting means 2. Thus the breather 6 is simply in the form of an elongated tube carrying at its lower end a cylindrical body which has an exterior threaded surface adapted to be threaded into the lower enlarged portion of the opening 5. At its bottom end the breather tube 6, which is open at its top end, carries a one-way valve which is capable of automatically opening in order to permit air to enter into the passage 7. The top end of the tubular breather 6 will extend into the mouth of the bottle while having an outer diameter which is much smaller than the interior diameter of the mouth of the bottle so that the liquid contents can flow readily from the bottle into the passage 7 around the exterior of the tubular breather 6. However as the liquid flows out of the bottle a vacuum is created at the top of the liquid, and in response to this vacuum the one-way valve at the bottom of the breather tube 6 will automatically open to admit air which thus facilitates flow of the liquid contents out of the bottle along the passage 7 into the passage 10. Thus the breather tube 6 connected to each fitting means 2 forms a means for admitting air into the path of liquid flow for facilitating the flow of liquid.

Figure 2:
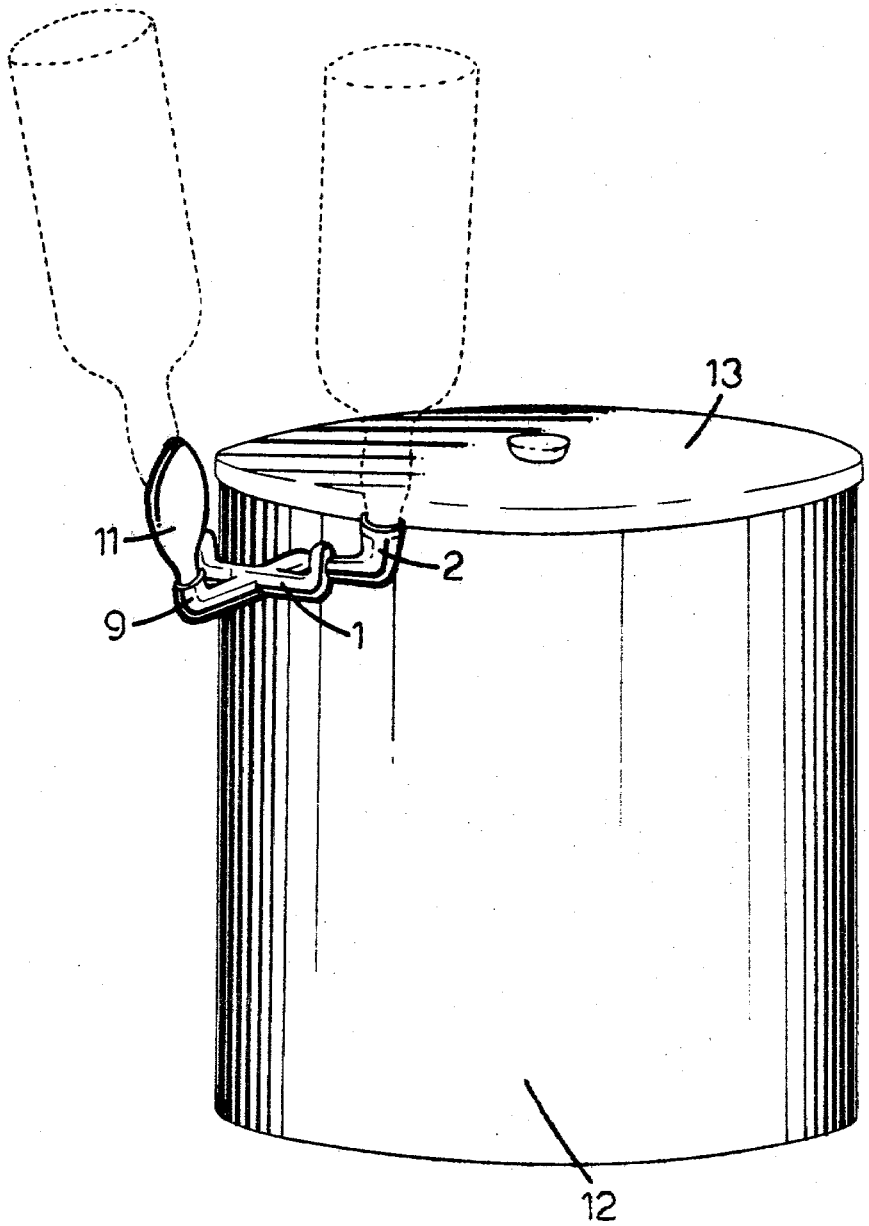
FIG. 2 is a perspective illustration of the device of the invention showing a pair of beverage-containing bottles connected to the device of the invention, with these bottles shown in phantom lines.

In addition, as is shown particularly in FIGS. 2 and 3, the left end portion of the tubular carrier means 1 is curved upwardly and carries a resilient tubular bulb 11 which can be compressed by the operator and released to expand. This bulb 11 has its interior in communication with the passage 10, and the bulb 11 carries at its top end, as viewed in FIGS. 1, 2, and 3, a one-way valve for admitting air into the bulb 11. Thus through this valve air can flow only into the bulb 11 but not out of the latter. Thus by way of this bulb 11 it is possible for the operator to feed air into the passage 10 as required to facilitate flow of liquid. In addition, after a liquid-containing receptacle has been completely emptied the bulb 11 may be manipulated so as to introduce into the system air which will force all of the liquid out through the coil 14 and the discharge valve 15.

Figure 4:
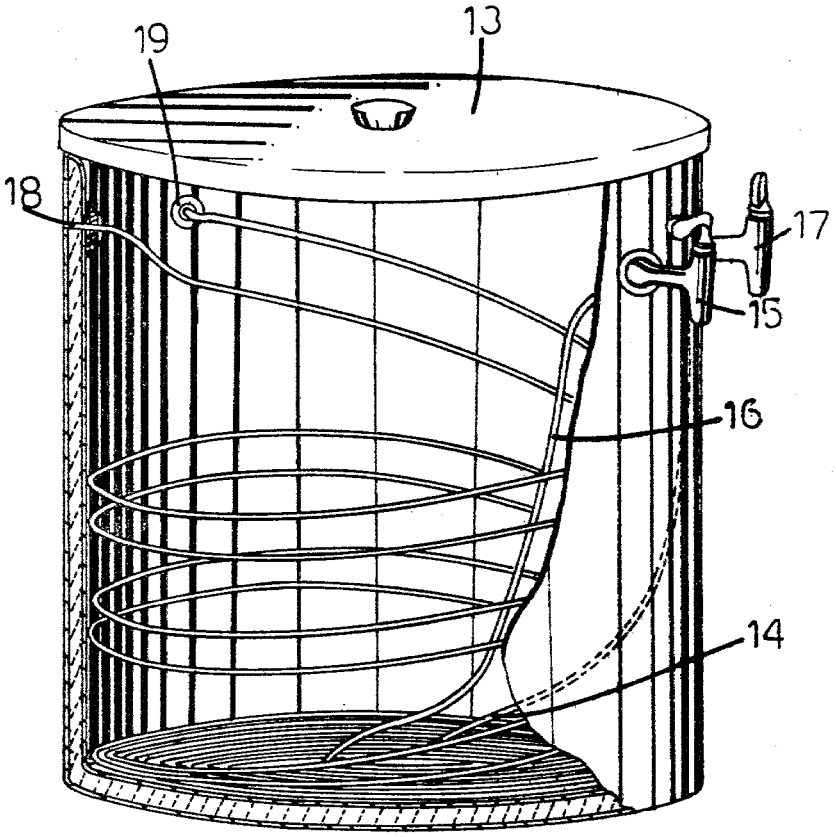
FIG. 4 is a sectional elevation of another embodiment of a device of the invention.

In the embodiment of FIG. 4, in addition to the coil 14, which is a flat coil situated at the bottom of the container means 12, in the interior thereof, there is a second coil 16 which has its convolutions distributed vertically along the interior of the container, and one end of this coil 6 communicates with a second manually operable discharge means 17 identical with the valve means 15. The other end of the coil 16 communicates with an opening in a wall portion of the container 12, a fitting 18 being situated at this opening to permit a tubular carrier means 1 of the invention to be fixed to the container means 12 in communication with the coil 16. In the same way the fitting 19 is shown in FIG. 4 for the purpose of enabling a second tubular carrier means 1 to be connected to the container 12 in communication with the lower coil 14 of FIG. 4. Thus with such an arrangement it is possible to multiply the number of bottles which are connected to the container means 12, with the pair of carrier means respectively communicating with the pair of coils 14 and 16 so that the valves 15 and 17 can be selectively manipulated for withdrawing liquid from receptacles carried by the pair of carrier means which are utilized with the embodiment of FIG. 4.

Thus, in order to use the device of the invention, it is only necessary to fill the container means 12 with a refrigerating medium such as ice. Then one or more bottles are connected to one or more carrier means 1 in the manner described above, and as soon as these bottles are inverted the liquid contents thereof will flow into the coils to be chilled before being discharged through one or more discharge valves. It will thus be seen that with the device of the invention even though the bottles may remain in a partially filled condition for a considerable time, nevertheless whenever the contents are withdrawn at the tap or faucet, these liquid contents are in a well-chilled condition. Furthermore, the only liquid which is chilled is the liquid which at any given time is flowing out of bottles connected to the carrier means of the invention. Unopened bottles need not be chilled. Thus, by way of the device of the invention it is possible to provide an assured dispensation of a beverage in a well-chilled condition.

Of course variations are possible with the structure described above. For example, instead of the bulb 11 it is possible to provide simply a one-way valve which opens automatically in response to creation of vacuum in the interior of the tubular carrier means 1, in the same way as described above in connection with the breather tube 6. Also the breather tube 6 can, if desired, be provided at its bottom end with a squeezable bulb similar to the bulb 11 and carrying at its bottom end a one-way valve so that such a bulb can be manipulated to introduce air through the tubular component 6 into the interior of the bottle.

Moreover, by providing the carrier means 1 with a pair of fitting means 2, it is possible to connect a full bottle to one fitting means 2 when the bottle connected to the other fitting means has been partially emptied, so that in this way a continuous supply of beverage at the discharge tap is assured.

What is claimed is:

1. In a portable device for dispensing a liquid in chilled condition, container means for containing a refrigerating medium such as ice, said container means carrying a manually operable discharge valve means which is accessible at the exterior of said container means to be manipulated for discharging chilled liquid and for terminating the discharge of chilled liquid, said container means having distant from said valve means a wall portion formed with an opening passing therethrough, tubular coil means situated in said container means and having a pair of opposed ends one of which is connected to and communicates with said valve means and the other of which is connected to said container means at said opening of said wall portion thereof in communication with said opening, so that a liquid delivered to said container means at said opening of said wall portion thereof will flow through said tubular coil means to said discharge valve means while being chilled by the refrigerating medium in said container means which engages the exterior surface of said tubular coil means to act therethrough for chilling a liquid in said tubular coil means, tubular carrier means connected with said container means at said opening of said wall portion thereof and extending outwardly beyond said container means from said opening of said wall portion thereof, said tubular carrier means having a first passage portion communicating with said tubular coil means through said opening of said wall portion of said container means, and said tubular carrier means carrying a fitting means for releasably connecting to said carrier means a liquid-containing receptacle, said fitting means having a second passage portion for fluidly intercommunicating the liquid contained in the receptacle and said first passage portion in a manner providing a continuous passage for flow of liquid from the receptacle through the first and second passage portions into said coil means so that liquid from the receptacle will be chilled before reaching said valve means and means communicating with said first passage portion for introducing pressure thereinto to facilitate the flow of the liquid through the first passage portion into the tubular coil means, said tubular carrying means carrying a plurality of said fitting means so that a plurality of liquid-containing receptacles can be respectively connected with said plurality of fitting means for supplying liquid from the plurality of receptacles through said coil means to said discharge valve means, said connecting means connecting each fitting means to said carrier means for movement with respect thereto between a position where said second passage portion communicates with the first passage portion and a position where said second passage portion is out of communication with the first passage portion.

2. In a portable device for dispensing a liquid in chilled condition, container means for containing a refrigerating medium as as ice, said container means carrying a manually operable discharge valve means which is accessible at the exterior of said container means to be manipulated for discharging chilled liquid and for terminating the discharge of chilled liquid, said container means having distant from said valve means a wall portion formed with an opening passing therethrough, tubular coil means situated in said container means and having a pair of opposed ends one of which is connected to and communicates with said valve means and the other of which is connected to said container means at said opening of said wall portion thereof in communication with said opening, so that a liquid delivered to said container means at said opening of said wall portion thereof will flow through said tubular coil means to said discharge valve means while being chilled by the refrigerating medium in said container means which engages the exterior surface of said tubular coil means to act therethrough for chilling a liquid in said tubular coil means, tubular carrier means connected with said container means at said opening of said wall portion thereof and extending outwardly beyond said container means from said opening of said wall portion thereof, said tubular carrier means having a first passage portion communicating with said tubular coil means through said opening of said wall portion of said container means, and said tubular carrier means carrying a fitting means for releasably connecting to said carrier means a liquid-containing receptacle, said fitting means having a second passage portion for fluidly interconnecting the liquid contained in the receptacle and said first passage portion in a manner providing a continuous passage for flow of liquid from the receptacle through the first and second passage portions into said coil means so that liquid from the receptacle will be chilled before reaching said valve means, said second portion passage having an extended portion fluidly intercommunicating said second passage portion and the external atmosphere and one-way valve means located in said extended portion for permitting air to enter into said second passage portion, and means communicating with said first passage portion for introducing pressure thereinto to facilitate the flow of the liquid through the first passage portion into the tubular coil means.

3. The combination of claim 2 further including a breather tube having one end communicating with said extended portion and its other end opening in the region where the receptacle is connected to said fitting means.

* * * * *